US008500532B2

(12) United States Patent
Chang

(10) Patent No.: US 8,500,532 B2
(45) Date of Patent: Aug. 6, 2013

(54) MACHINE-IMPLEMENTED METHOD OF HANDLING HAND TILES/CARDS OF A VIRTUAL PLAYER DURING A TILE/CARD GAME AND GAMING APPARATUS

(75) Inventor: Eric Chang, Taipei (TW)

(73) Assignee: XPEC Entertainment Inc., Tapei (TW)

( * ) Notice: Subject to any disclaimer, the term of this patent is extended or adjusted under 35 U.S.C. 154(b) by 131 days.

(21) Appl. No.: 13/242,269

(22) Filed: Sep. 23, 2011

(65) Prior Publication Data

US 2013/0079083 A1 Mar. 28, 2013

(51) Int. Cl.
*G07F 17/32* (2006.01)

(52) U.S. Cl.
USPC ..... 463/11; 463/9; 463/31; 463/42

(58) Field of Classification Search
USPC ..... 463/9, 11, 31
See application file for complete search history.

(56) References Cited

U.S. PATENT DOCUMENTS

2004/0018876 A1* 1/2004 Kubota et al. ..... 463/42
2006/0131810 A1* 6/2006 Nicely ..... 273/292

* cited by examiner

*Primary Examiner* — Omkar Deodhar
(74) *Attorney, Agent, or Firm* — Pillsbury Winthrop Shaw Pittman, LLP

(57) ABSTRACT

A method performed by a gaming apparatus is provided for handling hand tiles of a virtual player during a tile game. The tile game is played using plural virtual playing tiles from which the hand tiles are drawn. The gaming apparatus stores a preference parameter set associated with the virtual player and including tile points of the respective virtual playing tiles and combination points of various permissible combinations of the virtual playing tiles. During a turn of the virtual player, the gaming apparatus computes priority points of the respective hand tiles according to the preference parameter set, and then, makes the virtual player discard one of the hand tiles that is selected according to the priority points.

19 Claims, 8 Drawing Sheets

30

MACHINE-IMPLEMENTED METHOD OF HANDLING HAND TILES/CARDS OF A VIRTUAL PLAYER DURING A TILE/CARD GAME AND GAMING APPARATUS

BACKGROUND OF THE INVENTION

1. Field of the Invention

The present invention relates to a machine-implemented method of handling hand tiles/cards of a virtual player during a tile/card game and a gaming apparatus for performing the machine-implemented method, more particularly to a machine-implemented method of handling hand tiles/cards of a virtual player according to preferences of the virtual player during a tile/card game and a gaming apparatus for performing the machine-implemented method.

2. Description of the Related Art

Mahjong is a game originated from China and is very popular in Asia. Four players are required to play Mahjong, and people cannot play Mahjong (or other multiplayer tile/card games) as they wish due to shortage of players sometimes.

Therefore, there is a conventional gaming method of playing Mahjong, and people can play Mahjong with virtual players using a gaming apparatus capable of performing the conventional gaming method. However, artificial intelligence of the virtual players in the conventional gaming method is designed to merely pursue winning and lacks human personality. Moreover, not only skills of the player himself but also awareness of other players' usual practices and personal preference are important for winning a game of Mahjong. The conventional gaming method fails to simulate the usual practices and personal preferences of virtual players during a game of Mahjong. Thus, playing Mahjong with the virtual players through the conventional gaming method is relatively uninteresting since the virtual players merely pursue winning without human personality.

SUMMARY OF THE INVENTION

Therefore, an object of the present invention is to provide a method capable of handling a plurality of hand tiles/cards of a virtual player according to preset preferences of a virtual player during a tile/card game.

Accordingly, a machine-implemented method of this invention is provided for handling a plurality of hand tiles/cards of a virtual player during a tile/card game. The tile/card game is to be played using a plurality of virtual playing tiles/cards from which the hand tiles/cards are drawn. The machine-implemented method is to be performed by a gaming apparatus, and comprises the steps of.

a) configuring the gaming apparatus to store a preference parameter set associated with the virtual player, the preference parameter set including tile/card points of the respective virtual playing tiles/cards used in the tile/card game and combination points of various permissible combinations of the virtual playing tiles/cards;

b) during a turn of the virtual player, configuring the gaming apparatus to compute priority points of the respective hand tiles/cards of the virtual player according to the preference parameter set associated with the virtual player; and c) configuring the gaming apparatus to make the virtual player discard one of the hand tiles/cards that is selected according to the priority points when a game winning condition is yet to be met.

According to another aspect, a gaming apparatus of this invention is operable to allow a user to play a tile/card game with at least one virtual player using a plurality of virtual playing tiles/cards. The gaming apparatus comprises a storage unit and a control unit.

The storage unit stores a preference parameter set associated with the virtual player and program instructions for performing a machine-implemented method of handling a plurality of hand tiles/cards of the virtual player during the tile/card game. The preference parameter set includes tile/card points of the respective virtual playing tiles/cards used in the tile/card game and combination points of various permissible combinations of the virtual playing tiles/cards.

The control unit is operable to execute the program instructions stored in the storage unit to implement the machine-implemented method that includes the steps of.

i) during a turn of the virtual player, computing priority points of the respective hand tiles/cards of the virtual player according to the preference parameter set associated with the virtual player; and ii) making the virtual player discard one of the hand tiles/cards that is selected according to the priority points when a game winning condition is yet to be met.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OP THE PREFERRED EMBODIMENTS

Figure 1:
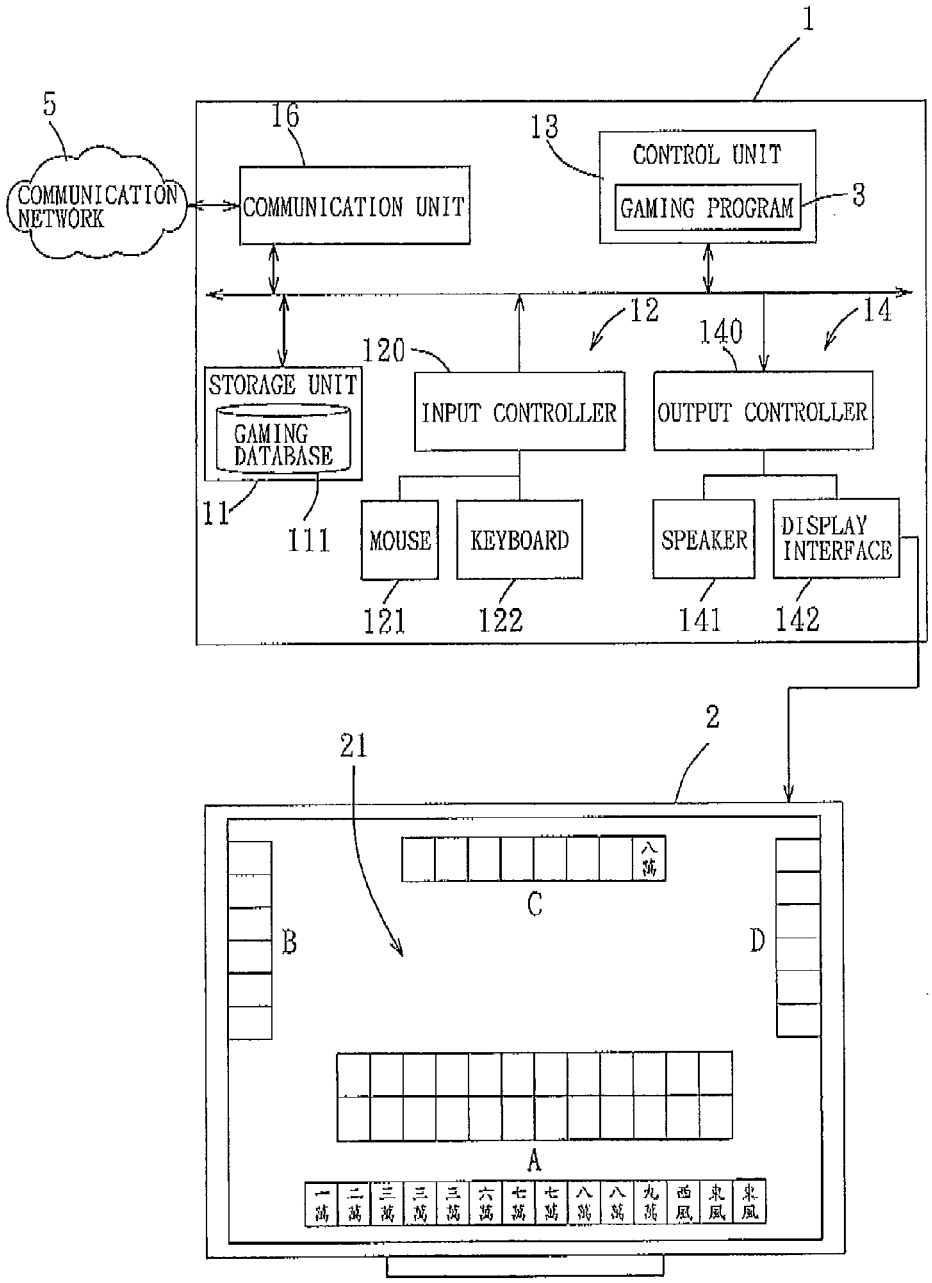
FIG. 1 is a system block diagram of a preferred embodiment of a gaming apparatus according to this invention.

Referring to FIG. 1, a preferred embodiment of a gaming apparatus 1 according to the present invention includes a storage unit 11, an input unit 12, a control unit 13, an output unit 14 and a communication unit 16. For example, the gaming apparatus 1 is a computer, a game console, a portable electronic device (such as a cell phone, a smart phone, or a personal digital assistant), etc., and is operable to allow a user to play a tile/card game (such as Mahjong, a poker game, etc.) with at least one virtual player using a plurality of virtual playing tiles/cards.

The input unit 12 includes an input controller 120 and an operation interface including a mouse 121 and a keyboard 122 in this embodiment. The user of the gaming apparatus 1 may input commands and data using the mouse 121 and the keyboard 122, and the commands and the data are sent to the control unit 13 though the input controller 120. It should be noted that the operation interface may be a touch pad in other embodiments, and is not limited to the mouse 121 and the keyboard 122 disclosed in this embodiment.

The control unit 13 is coupled to the storage unit 11, the input unit 12, the output unit 14 and the communication unit 16, and is configured to receive the commands from the input unit 12. The control unit 13 is operable to control and coordinate operation of the output unit 14 and the communication unit 16 in response to the commands from the input unit 12, and to generate audio signals and video signals related to sound effects and gaming images 21 of the tile/card game. Further, a gaming program 3 for playing the tile/card game is installed in the control unit 13, and has program instructions which when executed cause the control unit 13 to access the data stored in the storage unit 11 and to perform a gaming method for playing the tile/card game.

The output unit 14 includes an output controller 140, a speaker 141, a display interface 142, and a display device 2 electrically connected to the display interface 142. The output controller 140 is operable to output the audio signals received from the control unit 3 to the speaker 141 for generating the sound effects associated with the tile/card game, and to output the video signals received from the control unit 3 to the display device 2 through the display interface 142 for generating the gaming images 21 of the tile/card game.

The communication unit 16 is, for example, a wired/wireless network communication interface configured for connection with a communication network to thereby allow the user to play an online tile/card game with other players through the communication network 5.

Figure 2:
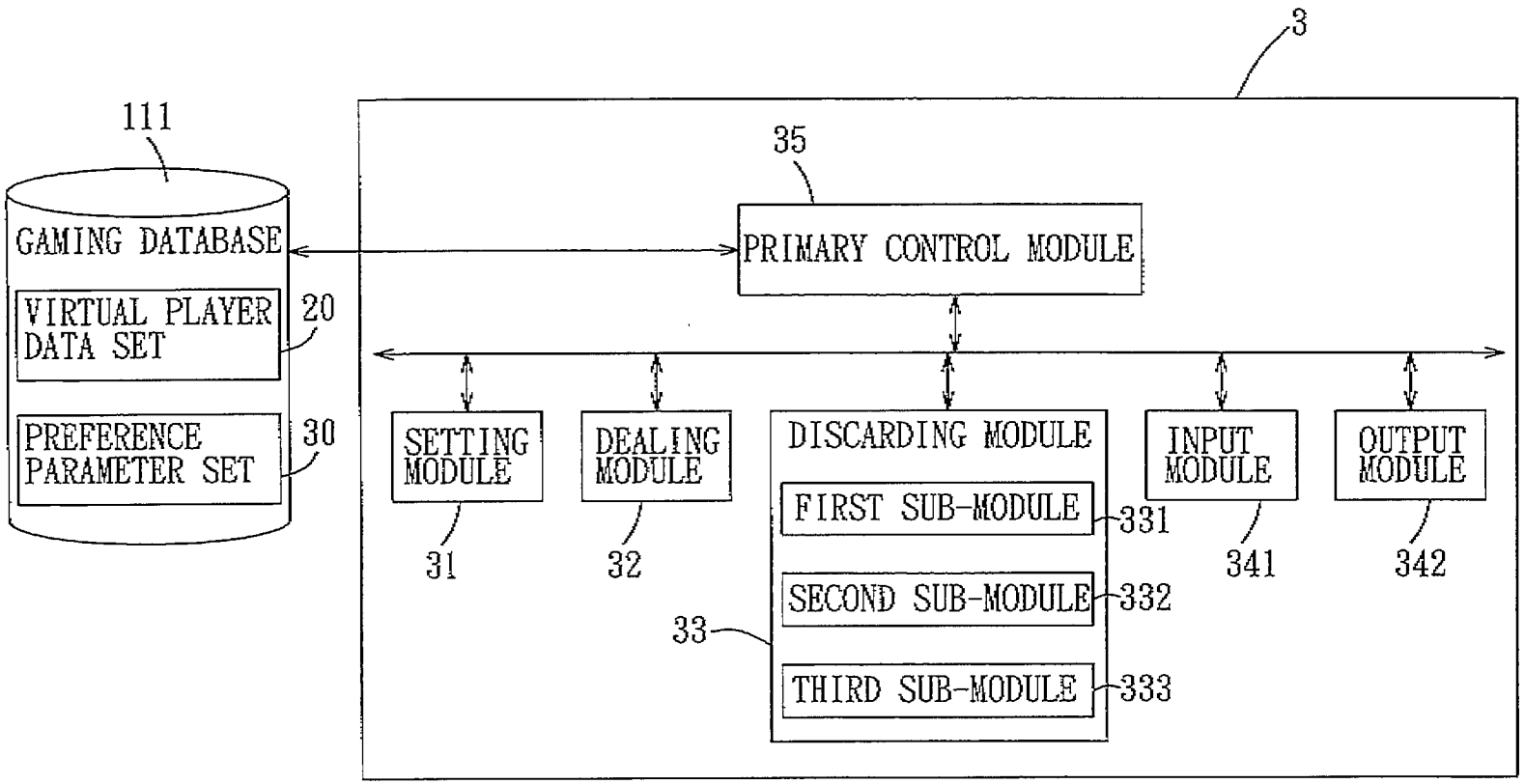
FIG. 2 is a block diagram illustrating a gaming program and a gaming database of the gaming apparatus of the preferred embodiment.
Figure 3:
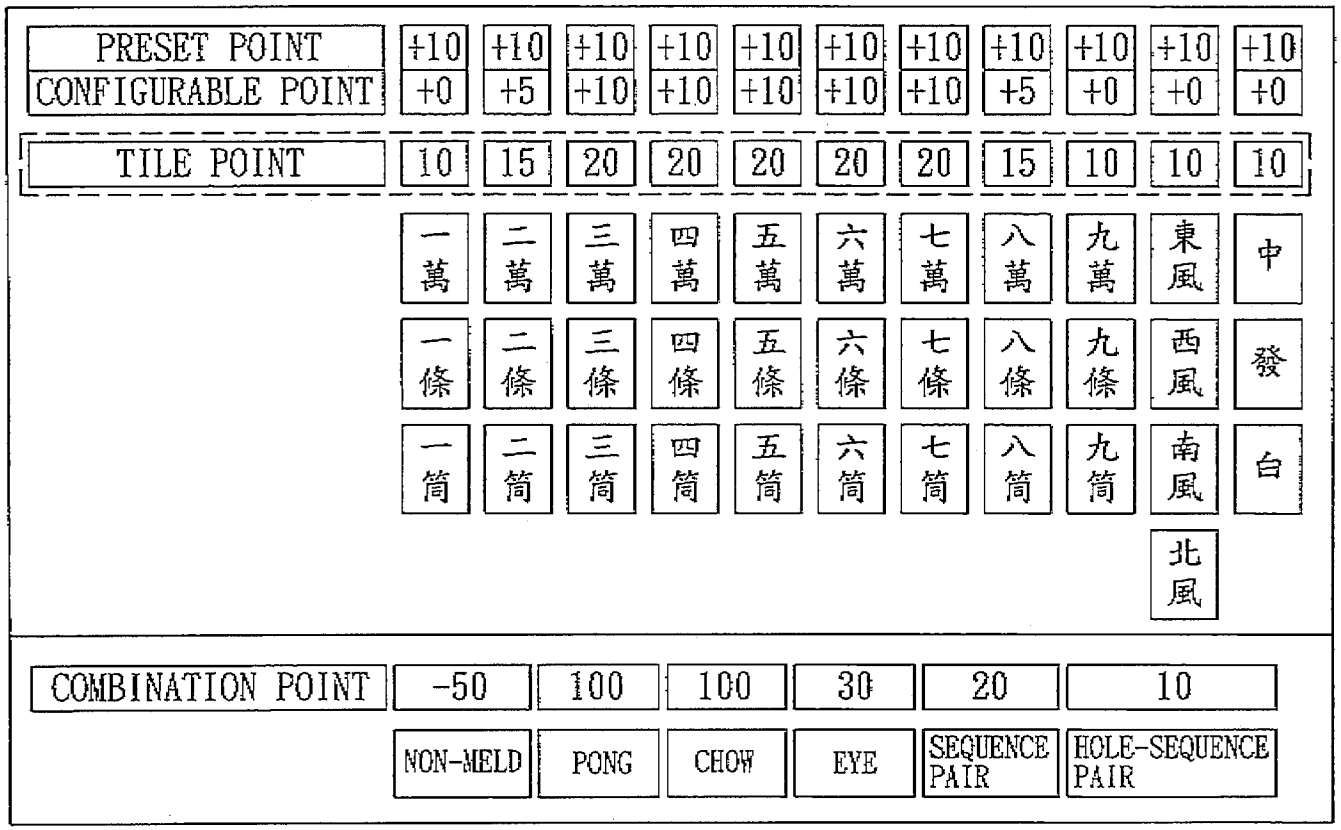
FIG. 3 is a schematic diagram illustrating a preference table containing a preference parameter set associated with a virtual player.

Referring to FIGS. 1 and 2, the storage unit 11 stores a gaming database 111 including a plurality of data sets 20 of respective virtual players of the tile/card game and a plurality of preference tables (see FIG. 3). Each of the preference tables contains a preference parameter set 30 therein that is associated with a respective one of the virtual players and that includes tile/card points of the respective virtual playing tiles/cards used in the tile/card game and combination points of various permissible combinations of the virtual playing tiles/cards.

It should be noted that the tile/card points and the combination points of the preference parameter set 30 associated with a corresponding one of the virtual players may differ from those points of another preference parameter set 30 associated with another one of the virtual players. For each of the virtual players, the control unit 13 is operable to set the preference parameter set 30 stored in the gaming database 111 in response to the commands from the input unit 12, and to determine priority to discard hand tiles/cards of the virtual player according to the preference parameter set 30.

In this embodiment, the tile/card game is Mahjong played by four players. Commonly, a match of Mahjong consists of four rounds, and at least four playing hands are played in each of the four rounds. The virtual playing tiles of Mahjong are split into three simple suits (i.e., Characters, Dots and Bamboos) and two honor suits (i.e., Winds and Dragons), and are concealed and stacked to form a square wall at the beginning of each of the playing hands. Each of the simple suits includes thirty six playing tiles numbered 1 to 9, and there are four matching playing tiles for each value, i.e., there are four Dots with the number 2 for example. The honor suit of the Winds includes four matching playing tiles of East Wind, four matching playing tiles of West Wind, four matching playing tiles of South Wind, and four matching playing tiles of North Wind. The honor suit of the Dragons includes four matching playing tiles of Red Dragon, four matching playing tiles of Green Dragon, and four matching playing tiles of White Dragon.

The permissible combinations of the virtual playing tiles of Mahjong include a pang that is a set of identical three of the virtual playing tiles, a chow that is a set of sequential three of the virtual playing tiles in one of the simple suits, an eye that is a pair of identical two of the virtual playing tiles, a sequence pair of sequential two of the virtual playing tiles in one of the simple suits, and a hole-sequence pair of two out of three of the virtual playing tiles in a chow. In particular, the sequence pair has two end holes each of which corresponds to a respective one of the virtual playing tiles in the same simple suit for composing the chow. For example, the sequence pair of the Dots with numbers 2 and 3 has two end holes corresponding to the Dots with numbers 1 and 4 for composing the chow, respectively. The hole-sequence pair has only one of an end hole and a middle hole each of which corresponds to a respective one of the virtual playing tiles in the same simple suit for composing the chow. For example, the hole-sequence pair of the Dots with numbers 5 and 7 has the middle hole corresponding to the Dot with the number 6 for composing the chow, and the hole-sequence pair of the Dots with numbers 1 and 2 has the end hole corresponding to the Dot with the number 3 for composing the chow.

One of the players wins the current playing hand when the hand tiles thereof meet a game winning condition in that the hand tiles can be split into a plurality of melds (i.e., the pongs or the chows) and an eye. Each of the players can meld a discarded playing tile from another player for completing a meld (pong or chow), and has to expose the meld completed by melding.

Referring to the preference parameter set 30 of the preference table shown in FIG. 3, in this embodiment, the tile point of each of the virtual playing tiles belonging to one of the simple suits includes a preset point corresponding to said one of the simple suits and a configurable point related to a numerical sequence of the virtual playing tiles in said one of the simple suits. The tile point of each of the virtual playing tiles belonging to the honor suits includes a preset point corresponding to said one of the honor suits.

The gaming program 3 for playing Mahjong has a primary control module 35, a setting module 31, a dealing module 32, a discarding module 33, an input module 341, and an output module 342.

The primary control module 35 is configured to receive, from the input module 341, the commands obtained by the input module 341 from the mouse 121 and the keyboard 122 of the input unit 12, and is operable to generate and output the audio signals and the video signals to the output unit 14 through the output module 342 for generating the sound effect and the gaming images 21 of Mahjong. The primary control module 35 is further operable to access the data of the gaming database 111 stored in the storage unit 11 for performing the gaming method for playing Mahjong.

The setting module 31 is operable to set the preference parameter set 30 associated with each virtual player in response to the user commands from the input unit 12. Alternatively, the setting module 31 may be configured to automatically set the preference parameter set 30 without the user commands. The dealing module 32 is operable to deal a plurality of hand tiles from the virtual playing tiles to each player (including the user of the gaming apparatus 1 and the virtual players) when a playing hand is started. The discarding module 33 is operable to determine which one of the hand tiles of the virtual player is to be discarded, and includes a first sub-module 331, a second sub-module 332, and a third sub-module 333.

During a turn of the virtual player to discard one of the hand tiles thereof into a center of the square wall formed by the concealed virtual playing tiles, the first sub-module 331 is operable to compute priority points of the respective hand tiles of the virtual player according to the preference parameter set 30 of the preference table (as shown in FIG. 3) associated with the virtual player. The second sub-module 332 is operable to process weighting of the priority points of the respective hand tiles according to exposed ones of the virtual playing tiles that were discarded into the center of the square wall or that belong to the exposed melds completed by melding. The third sub-module 333 is operable to add an additional negative point or positive point to the priority points according to the virtual playing tiles discarded by a last player and a next player with respect to the virtual player to thereby prevent other players from completing a meld by melding and from achieving the game winning condition. Accordingly, the discarding module 33 is operable to make the virtual player discard one of the hand tiles that is selected according to the priority points when the game winning condition is yet to be met, e.g., a gaming winning hand is yet to be formed.

Before implementing the gaming method for playing Mahjong, the gaming apparatus 1 is operable to allow the user thereof to decide to play Mahjong with the virtual players or to play an online Mahjong game. When the user decides to play Mahjong with the virtual players, the gaming apparatus 1 is operable to allow the user to select three virtual players or is operable to randomly select three virtual players so as to allow the user to play Mahjong with the selected three virtual players. On the other hand, when the user decides to play the online Mahjong game, the gaming apparatus 1 is operable to allow the user to create a new match or to join a to-be-started match that was created by another user and that has not started yet. If there are four users joining the match of the online Mahjong game, the gaming apparatus 1 is operable to start this match of the online Mahjong game. If there are less than four users joining the match of the online Mahjong game after a predetermined waiting time from creation of the match, the gaming apparatus 1 is operable to automatically select at least one virtual player to join the match such that this match has the required four players.

Figure 4:
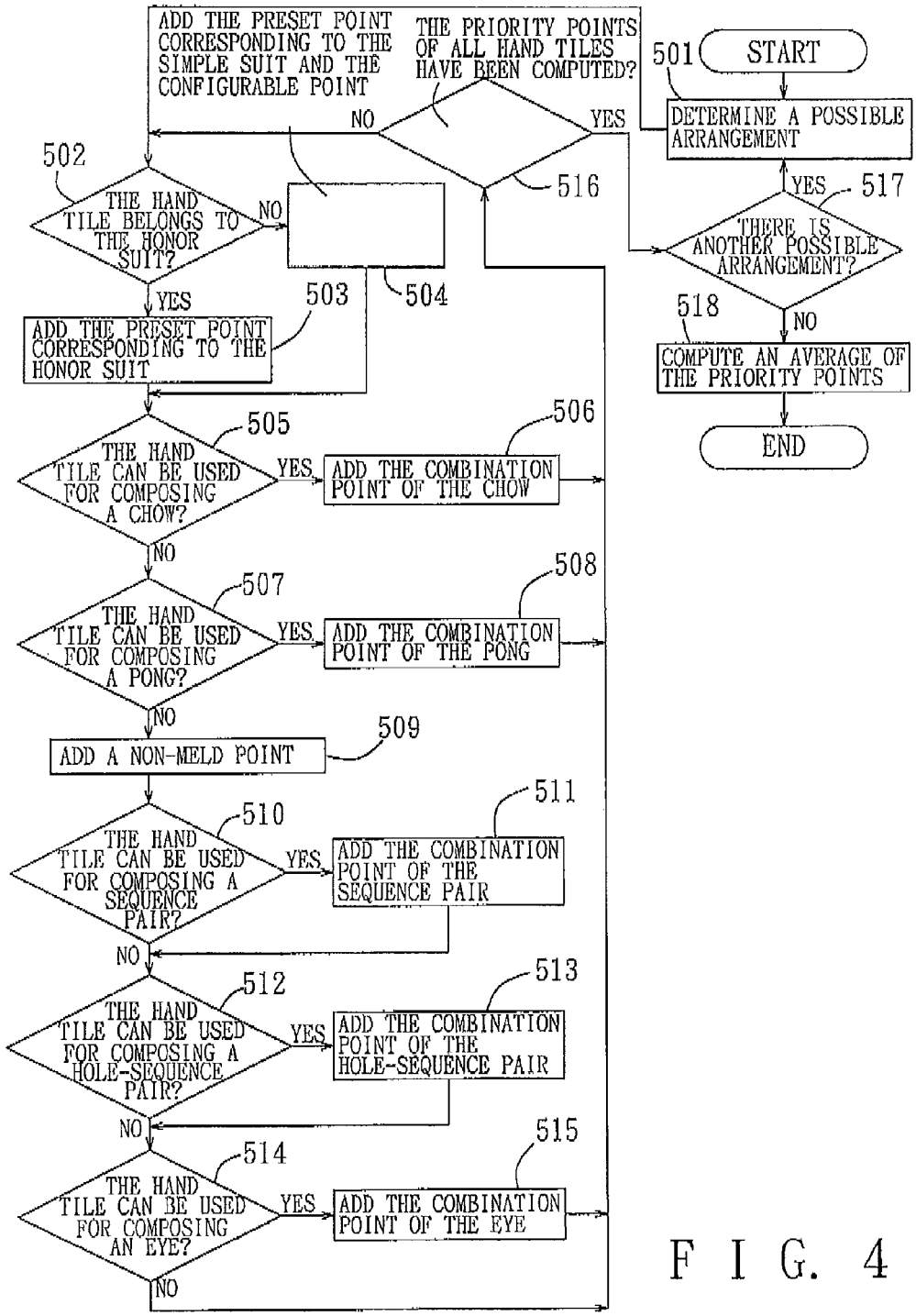
FIG. 4 is a flow chart of a first preferred embodiment of a machine-implemented method of handling hand tiles of a virtual player during a game of mahjong according to the present invention.

Referring to FIGS. 1, 2 and 4, when playing Mahjong with at least one virtual player, the first sub-module 331 of the discarding module 33 of the control unit 13 is configured to perform a first preferred embodiment of a machine-implemented method of handling the hand tiles of the virtual player during a game of Mahjong. The machine-implemented method of this embodiment includes the following steps.

During a turn of the virtual player, the first sub-module 331 is operable to determine a possible arrangement of the hand tiles of the virtual player in step 501. The possible arrangement has at least one of the permissible combinations composed by a part of the hand tiles. Taking the hand tiles of the virtual player (A) shown in the gaming image 21 of FIG. 1 as an example, one of the possible arrangements of the hand tiles of the virtual player (A) has a chow of "一萬", "二萬" and "三萬" (sequential three Characters with numbers 1 to 3), an eye of "三萬" and "三萬" (a pair of identical two Characters with number 3), a chow of "六 萬", "七萬" and "八萬" (sequential three Characters with numbers 6 to 8), a chow of "七萬", "八萬" and "九萬" (sequential three Characters with numbers 7 to 9), a single playing tile "西風" (West Wind), and an eye of "西風" and "西風" (East Wind).

For each of the hand tiles, the first sub-module 331 is operable to implement steps 502 to 515 for computing the priority point of each of the hand tiles.

In step 502, the first sub-module 331 is operable to determine whether the hand tile belongs to the honor suits (i.e., Winds and Dragons). In the hand tiles of the virtual player (A), there are three of the hand tiles belonging to Wind, that is, one West Wind "西風" and two East Winds "西風".

Then, in step 503, the first sub-module 331 is operable to add the preset point corresponding to said one of the honor suits to the priority point of the hand tile when it is determined in step 502 that the hand tile belongs to one of the honor suits. When it is determined in step 502 that the hand tile does not belong to one of the honor suits, i.e., the hand tile belongs to one of the simple suites, the first sub-module 331 is operable, in step 504, to add the preset point corresponding to one of the simple suits, to which the hand tile belongs, and the configurable point corresponding to order of the hand tile in said one of the simple suits to the priority point of the hand tile.

In step 505, the first sub-module 331 is operable to determine whether the hand tile can be used for composing a chow in the possible arrangement. Then, the first sub-module 331 is operable to add the combination point of the chow to the priority point of the hand tile in step 506 when the determination made in step 505 is affirmative, and to implement step 507 when otherwise.

In step 507, the first sub-module 331 is operable to determine whether the hand tile can be used for composing a pong in the possible arrangement. Then, the first sub-module 331 is operable to add the combination point of the pong to the priority point of the hand tile in step 508 when the determination made in step 507 is affirmative, and to implement step 509 when otherwise.

Since the game winning condition can only consist of the eye and a plurality of the chows and/or the pongs, the combination points of the chow and the pong are relatively greater. For example, the values of the combination points of the chow and the pong in the preference parameter set 30 of the preference table shown in FIG. 3 are equal to 100. Further, in other embodiments, the combination point of the pong may be greater than the combination point of the chow such that the virtual player will prefer the meld of the pong for achieving the game winning condition of a pong hand, which only has gongs and an eye, to obtain relatively more scores of a gaming winning hand in the current playing hand.

In step 509, the first sub-module 331 is operable to add a non-meld point that is less than the combination points of the chow and the pong to the priority point of the hand tile. Namely, the hand tile cannot be used for composing a meld (the chow or the pong) in the possible arrangement. In this embodiment, the non-meld point has a negative value such as −50 in the preference parameter set 30 of the reference table shown in FIG. 3. In this way, the virtual player will preferably discard the hand tile that cannot be used for composing a meld, and will not separate a completed meld by discarding one of the hand tiles in the completed meld.

In step 510, the first sub-module 331 is operable to determine whether the hand tile can be used for composing a sequence pair in the possible arrangement. For example, the Character with number 4 (四萬) can be used for composing a sequence pair (三萬, 四萬) in the possible arrangement shown in FIG. 9. Then, the first sub-module 331 is operable to add the combination point of the sequence pair (e.g., 20 in the preference parameter set 30 of the preference table shown in FIG. 3) to the priority point of the hand tile in step 511 when the determination made in step 510 is affirmative, and to implement step 512 when otherwise.

In step 512, the first sub-module 331 is operable to determine whether the hand tile can be used for composing a hole-sequence pair in the possible arrangement. For example, the Character with number 1 (一萬) can be used for composing a hole-sequence pair (一萬, 三萬) in the possible arrangement shown in FIG. 7. Then, the first sub-module 331 is operable to add the combination point of the hole-sequence pair (e.g., 10 in the preference parameter set 30 of the preference table shown in FIG. 3) to the priority point of the hand tile in step 513 when the determination made in step 512 is affirmative, and to implement step 514 when otherwise.

In step 514, the first sub-module 331 is operable to determine whether the hand tile can be used for composing an eye in the possible arrangement. For example, the two East Winds (東風) can be used for composing an eye in the possible arrangement of the hand tiles of the virtual player (A) shown in the gaming image 21 of FIG. 1. Then, the first sub-module 331 is operable to add the combination point of the eye (e.g., 30 in the preference parameter set 30 of the preference table shown in FIG. 3) to the priority point of the hand tile in step 515 when the determination made in step 519 is affirmative, and to implement step 516 when otherwise.

It should be noted that steps 502 to 515 may be performed in a different order in other embodiments. For instance, steps 502 to 503 may be performed after step 506, and/or steps 507 and 508 may be implemented before steps 505 and 506.

In step 516, the first sub-module 331 is operable to determine whether the priority points of all of the hand tiles have been computed. The first sub-module 331 is operable to perform step 517 when the determination made in step 516 is affirmative, and to repeat steps 502 to 515 for computing the priority point of said another one of the hand tiles when otherwise.

In step 517, the first sub-module 331 is operable to determine whether there is another possible arrangement of the hand tiles of the virtual player. When it is determined that there is another possible arrangement of the hand tiles, the flow goes back to step 501 with said another possible arrangement. When it is determined that there is no more possible arrangement of the hand tiles, the first sub-module 331 is operable, in step 510, to compute a score, e.g., an average of the priority points, of each of the hand tiles with respect to the respective possible arrangements.

Taking the hand tiles of the virtual player (A) shown in the gaming image 21 of FIG. 1 as an example with preference to the reference parameter set 30 in the preference table of FIG. 3, computation of the priority point of each of the hand tiles is described as follows.

For the first five Characters with numbers 1 to 3 (i.e., 一萬, 二萬, 三萬, 三萬, 三萬) there are two possible arrangements, a first one of which includes the chow (一萬, 二萬, 三萬) and the eye (三萬, 三萬) and a second one of which includes the pong (三萬, 三萬, 三萬) and the hole-sequence pair (一萬, 二萬)

Regarding the Character with number 1 (一萬) in the first one of the possible arrangements, a first priority point thereof is equal to 110 as a sum of the preset point (10), the configurable point (0), and the combination point of the chow (100). In the second one of the possible arrangements, a second priority point of the Character with number 1 (一萬) is equal to −30 as a sum of the preset point (10), the configurable point (0), the non-meld point (−50), and the combination point of the hole-sequence pair (10). Accordingly, the average priority point of the Character with number 1 (一萬) is equal to 40 as an average of the first priority point (110) and the second priority point (−30). Similarly, the Character with number 2 has the average priority point equal to 45.

Regarding the Characters with number 3 (三萬) in the first one of the possible arrangements, a first priority point of a first one of the Characters with number 3 (三萬) is equal to 120 as a sum of the preset point (10), the configurable point (10) and the combination point of the chow (100). For the other two of the Characters with number 3 (三萬) a first priority point thereof is equal to 0 as a sum of the preset point (10), the configurable point (10), the non-meld point (−50), and the combination point of the eye (30). In the second one of the possible arrangements, a second priority point of each of the Characters with number 3 (三萬) is equal to 120 as a sum of the preset point (10), the configurable point (10), and the combination point of the pong (100). Accordingly, the average priority point of the first one of the Characters with number 3 (三萬) is equal to 120 as an average of the first priority point (120) and the second priority point (120), and the average priority point of the other two of the Characters with number 3 (三萬) is equal to 60 as an average of the first priority point (0) and the second priority point (120).

Thus, the average priority point of West Wind (西 風) is equal to 10+0−50=−40 and is less than the average priority point of any one of other hand tiles of the virtual player (A). Therefore, the virtual player (A) will discard West Wind (西風) accordingly.

Figure 5:
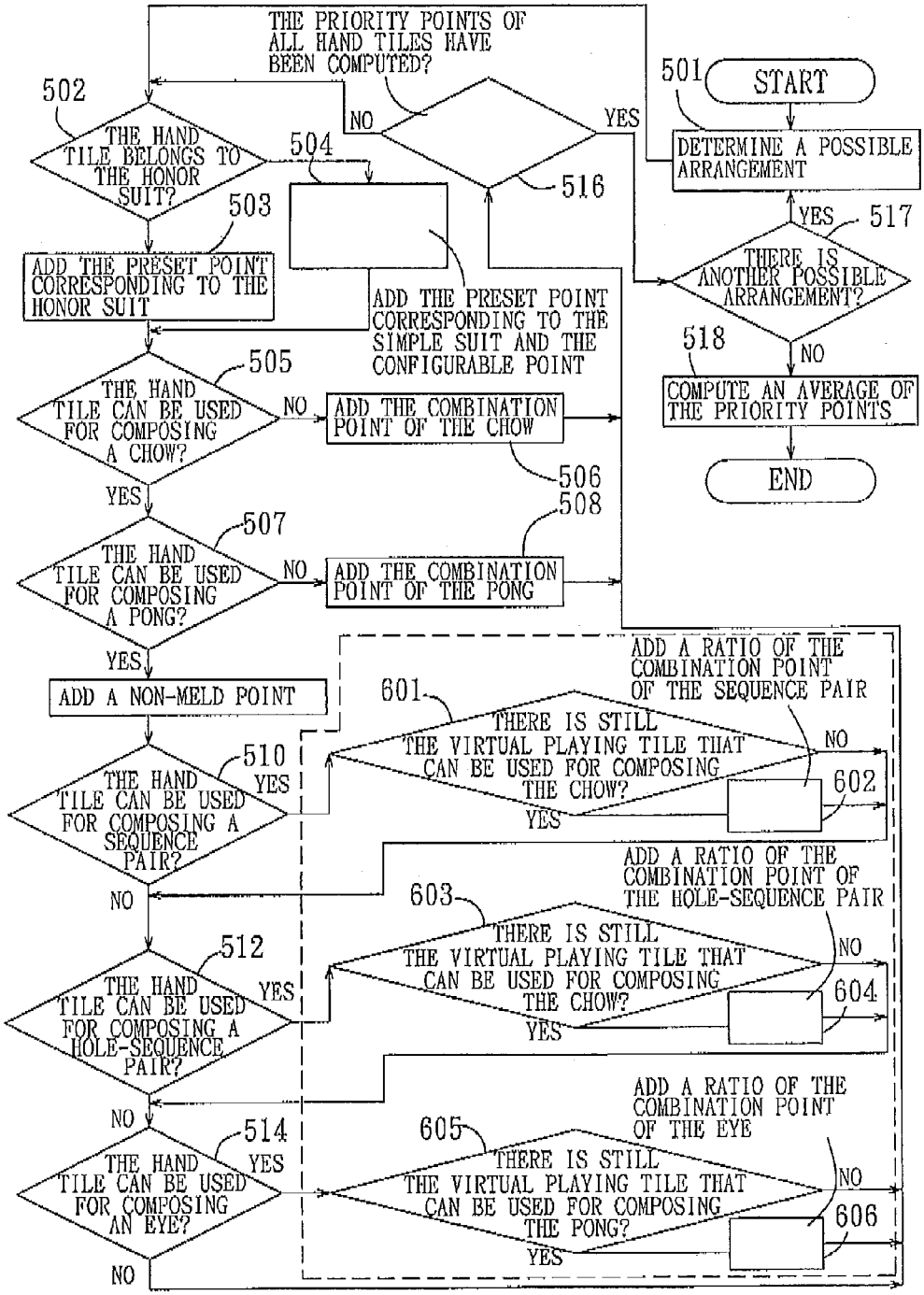
FIG. 5 is a flow chart of a second preferred embodiment of a machine-implemented method of handling hand tiles of a virtual player during a game of Mahjong according to the present invention.

Referring to FIGS. 2 and 5, a second preferred embodiment of a machine-implemented method of handling the hand tiles of the virtual player during a game of Mahjong is similar to the method of the first preferred embodiment. In this embodiment, steps 501 to 509, 510, 512, 514, 517 and 518 are similar to those of the first preferred embodiment. In the second preferred embodiment, for the hand tile that can be used with one of other hand tiles for composing one of the eye, the sequence pair and the hole-sequence pair, the second sub-module 332 of the discarding module 33 of the gaming program 3 in the control unit 13 is operable to determine whether there is still at least one of the virtual playing tiles that can be used for composing one of the pong and the chow with the hand tile and said one of other hand tiles and that remains concealed.

When it is determined in step 510 that the hand tile can be used for composing a sequence pair in the possible arrangement, the second sub-module 332 is operable, in step 601, to determine whether there is still at least one of the virtual playing tiles that can be used for composing the chow with the sequence pair including the hand tile and that remains concealed. It should be noted that one of the virtual playing tiles is unconcealed if said one of the virtual playing tiles is discarded into the center of the square wall or is used for composing the exposed meld completed by melding. The flow goes to step 602 when it is determined that there is still said at least one of the virtual playing tiles, and goes to step 512 when otherwise.

In step 602, the second sub-module 332 is operable to determine a number of said at least one of the virtual playing tiles that can be used for completing the chow with the sequence pair having the hand tile and that remains concealed, and to add a ratio of the combination point of the sequence pair to the hand tile according to the number of said at least one of the virtual playing tiles that remains concealed.

When it is determined in step 512 that the hand tile can be used for composing a hole-sequence pair in the possible arrangement, the second sub-module 332 is operable, in step 603, to determine whether there is still at least one of the virtual playing tiles that can be used for composing the chow with the hole-sequence pair including the hand tile and that remains concealed. The flow goes to step 604 when it is determined that there is still said at least one of the virtual playing tiles, and goes to step 514 when otherwise.

In step 604, the second sub-module 332 is operable to determine a number of said at least one of the virtual playing tiles that can be used for completing the chow with the hole-sequence pair having the hand tile and that remains concealed, and to add a ratio of the combination point of the hole-sequence pair to the hand tile according to the number of said at least one of the virtual playing tiles that remains concealed.

When it is determined in step 514 that the hand tile can be used for composing an eye in the possible arrangement, the second sub-module 332 is operable, in step 605, to determine whether there is still at least one of the virtual playing tiles that can be used for composing the pong with the eye including the hand tile and that remains concealed. The flow goes to step 606 when it is determined that there is still said at least one of the virtual playing tiles, and goes to step 516 when otherwise.

In step 606, the second sub-module 332 is operable to determine a number of said at least one of the virtual playing tiles that can be used for completing the pong with the eye having the hand tile and that remains concealed, and to add a ratio of the combination point of the eye to the hand tile according to the number of said at least one of the virtual playing tiles that remains concealed.

Figure 9:
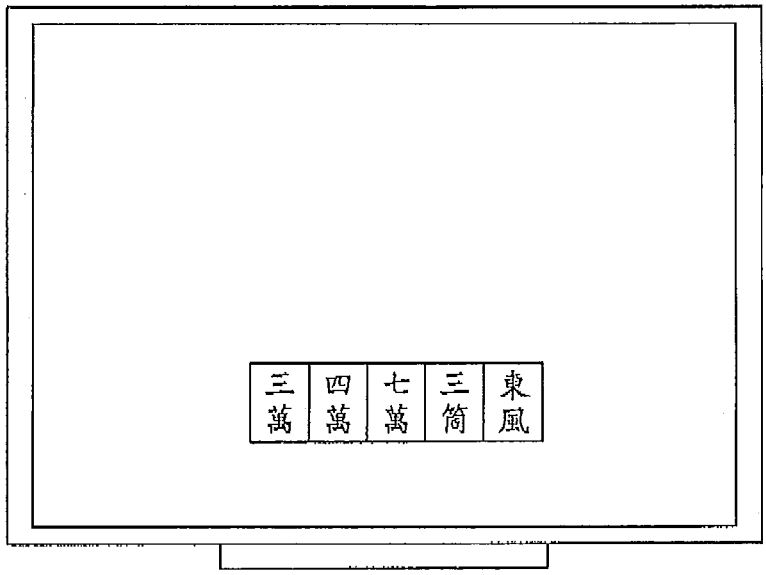
FIG. 9 is a gaming image of Mahjong illustrating yet another example of hand tiles of a virtual player.

For example, when it is determined in step 510 that the Character with the number 4 (四萬) in the possible arrangement shown in FIG. 9 can be used for composing the sequence pair (三萬, 四萬) the second sub-module 332 is operable, in step 601, to determine whether there is still at least one of the Characters with the number 2 or 5 (二萬, 五萬) that can be used for completing the chow of the Characters with numbers 2 to 4 or 3 to 5 (二萬, 三萬, 四萬 or 三萬, 四萬, 五萬) with the sequence pair (三萬, 四萬) having the Character with the number 4 ((四萬)) and that remains concealed. If two of the eight Characters with number 2 and 5 have been exposed or unconcealed, i.e., there are still six of the eight Characters with the number 2 or 5 that are concealed, the second sub-module 332 is operable, in step 602, to add ⅝ of the combination point of the sequence $$\left(\text{i.e., } 20 \times \frac{6}{8} = 15\right)$$

to the priority point of the Character with the number 4 (四萬). If all of the Characters with number 2 or 5 have been exposed or unconcealed, the second sub-module 332 will not add the combination point of the sequence to the priority point of the Character with the number 4 (四萬) since it is no longer possible to complete the chow with the sequence pair (三萬, 四萬). In this way, the virtual player may achieve the game winning condition relatively fast without waiting for the virtual playing tiles, all of which have been exposed or unconcealed, for composing the meld.

Figure 7:
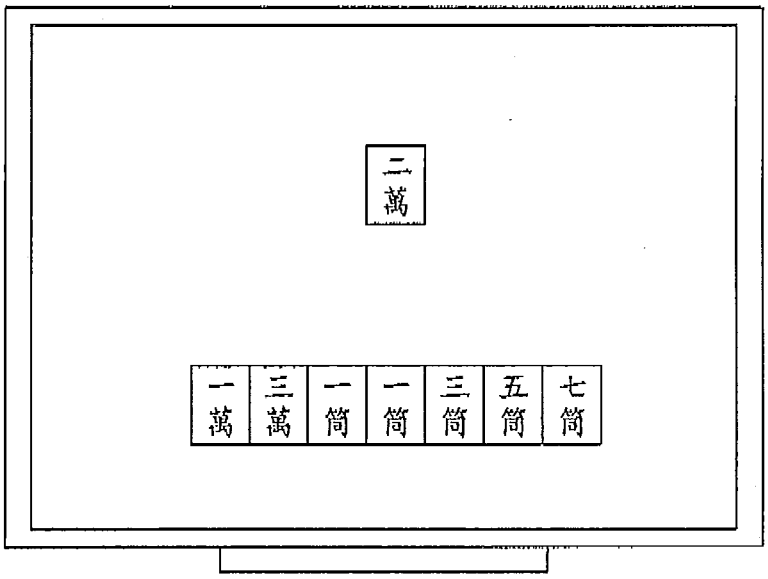
FIG. 7 is a gaming image of Mahjong illustrating an example of hand tiles of a virtual player.

Taking the Character with the number 1 (一萬) in the possible arrangement shown in FIG. 7 as another example, when it is determined in step 512 that the Character with the number 1 (一萬) can be used for composing the hole-sequence pair (一萬, 三萬), the second sub-module 332 is operable, in step 603, to determine whether there is still at least one of the Characters with the number 2 (二萬) that can be used for completing the chow of the Characters with numbers 1 to 3 (一萬, 二萬, 三萬) with the sequence pair (一萬, 三萬) having the Character with the number 1 (一萬) and that remains concealed. If three of the four Character with the number 2 have been exposed or unconcealed, i.e., there is still one of the four Character with the number 2 that is concealed, the second sub-module 332 is operable, in step 604, to add ¼ of the combination point of the sequence $$\left(\text{i.e., } 10 \times \frac{1}{4} = 2.5\right)$$

to the priority point of the Character with the number 1 (一萬).

Figure 6:
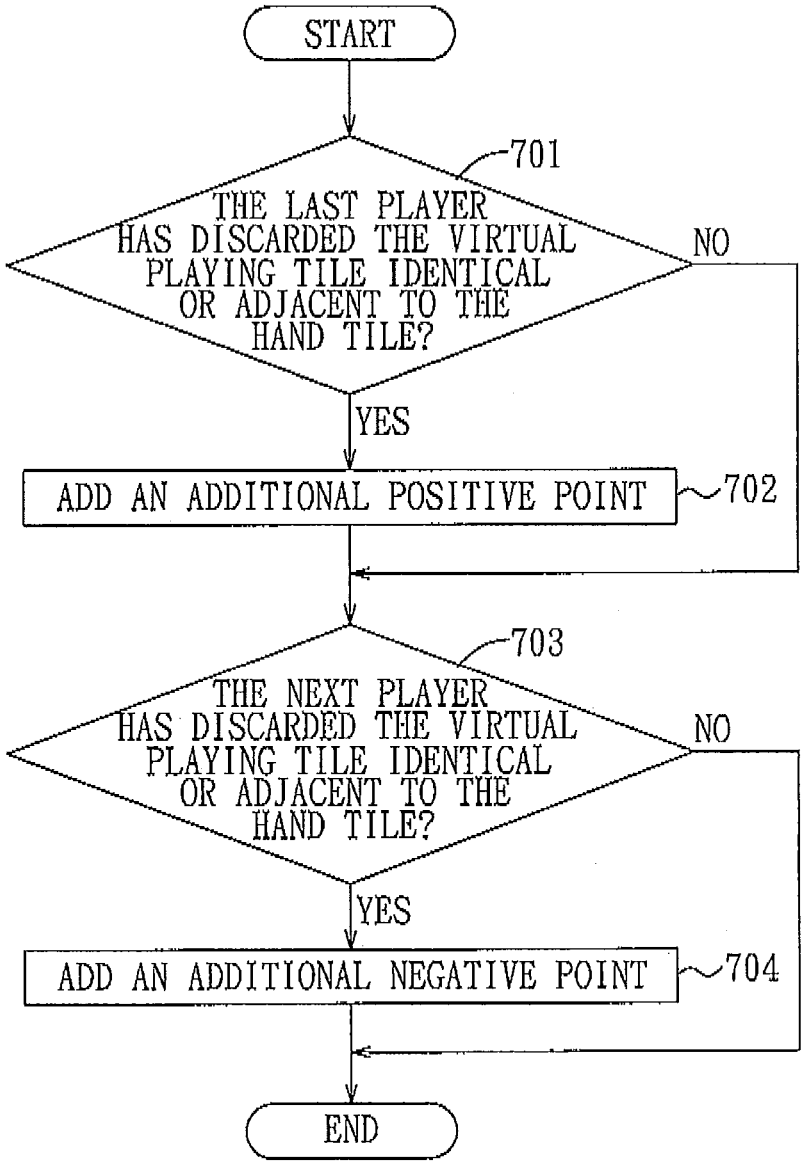
FIG. 6 is a flow chart of a watching/following procedure of the machine-implemented method of handling hand tiles for watching a next player and for following a last player according to the present invention.

Referring to FIGS. 2 and 6, the machine-implemented method of handling the hand tiles of the virtual player further includes a watching/following procedure for watching the next player and for following the last player. The watching/following procedure includes steps 701 to 704 implemented by the third sub-module 333 for each of the hand tiles of the virtual player. It should be noted that steps 701 to 704 may be implemented between steps 501 and 516.

In step 701, the third sub-module 333 is operable to determine whether the last player with respect to the virtual player has discarded one of the virtual playing tiles that is identical or adjacent to the hand tile in terms of numerical sequence. The third sub-module 333 is operable to implement step 702 of adding an additional positive point to the priority point of the hand tile when the determination made in step 701 is affirmative, and to implement step 703 when otherwise.

In step 703, the third sub-module 333 is operable to determine whether the next player with respect to the virtual player has discarded one of the virtual playing tiles that is identical or adjacent to the hand tile in terms of numerical sequence. The third sub-module 333 is operable to implement step 704 when the determination made in step 703 is affirmative, and to complete the watching/following procedure when otherwise.

In step 704, the third sub-module 333 is operable to add an additional negative point to the priority point of the hand tile.

It should be noted that, when it is determined in step 701 that the last player has discarded the virtual playing tiles identical or adjacent to the hand tile, it means that the last player does not need these virtual playing tiles, and the virtual player may have a relatively greater chance to meld the virtual playing tiles discarded by the last player for completing the chow or the pong with the hand tile. Therefore, the third sub-module 333 is operable, in step 702, to add the additional positive point to the priority point of the hand tile so as to make the virtual player keep the hand tile. When it is determined in step 703 that the next player has discarded the virtual playing tiles identical or adjacent to the hand tile, it means that the next player has a relatively lower chance to meld the hand tile if the virtual player discards it. Therefore, the third sub-module 333 is operable, in step 704, to add the additional negative point to the priority point of the hand tile so as to make the virtual player discard the hand tile. In this way, the virtual player is capable of watching the next player to prevent the next player from achieving the game winning condition, and of following the last player to have a relatively greater chance to complete the chow or the pong.

In addition, the preference parameter set 30 of the each of the virtual players may further include a chow threshold value and pong threshold value. The control unit 13 is further operable to compute a total point of the hand tiles of the virtual player as a sum of the respective priority points of the hand tiles. When there is a chance to meld a discarded playing tile from another player for completing the chow or the pong, the control unit 13 is operable to compute an assumed point of the hand tiles after melding and compare the assumed point with the total point. Then, the control unit 13 is operable to make the virtual player meld the discarded playing tile when the assumed point is greater than the total point with the chow threshold value or the pong threshold value.

For example, Table 1 indicates a first preference parameter set associated with a first virtual player who prefers not to meld the discarded playing card from another player, and a second preference parameter set associated with a second virtual player who prefers to meld the discarded playing tile for completing the chow or the pong.

TABLE 1

| Preference Parameter | First Set | Second Set |
|---|---|---|
| Pong Threshold | 200 | 20 |
| Chow Threshold | 200 | 20 |

Referring to FIG. 7, the hand tiles include one Character with the number 1 (一萬), one Character with the number 3 (三萬), two Dots with the number 1 (一筒), one Dot with the number 3 (三筒), one Dot with the number 5 (五筒), and one Dot with the number 7 (七筒). The priority points of the hand tiles (一萬, 三萬, 一筒, 三 筒, 五筒, and 七筒) are equal to −30, −20, −10, −20, −10 and −20, respectively. Accordingly, the total point of the hand tiles is equal to −120. When another player discards the Character with the number 2 (二萬), the control unit 13 is operable to compute the assumed point of the hand tiles that is equal to −5 after melding the Character with the number 2 (二萬) for completing the Chow with the Characters with number 1 and 3.

In the case of the first virtual player, the assumed point (−5) is greater than the total point (−120) with a value of 115, which is less than the chow threshold value (200) and the pong threshold value (200) of the first preference parameter set associated therewith. Thus, the control unit 13 is operable to make the first virtual player not to meld the Character with the number 2 (二萬). Accordingly, the first virtual player has a relatively greater chance to achieve the game winning condition without melding for obtaining relatively more scores of a gaming winning hand in the current playing hand.

In the case of the second virtual player, the assumed point (−5) is greater than the total point (−120) with the chow threshold value (20) and the pong threshold value (20) of the second preference parameter set associated therewith. Thus, the control unit 13 is operable to make the second virtual player to meld the Character with the number 2 (二萬) for completing the Chow with the Characters with number 1 and 3 (一萬, 三 萬). Accordingly, the second virtual player may achieve the game winning condition relatively fast by melding.

Table 2 exemplarily provides a third preference parameter set associated with a third virtual player who prefers to compose the pong for achieving the pong hand (only having the pongs and an eye), and a fourth preference parameter set associated with a fourth virtual player who prefers to compose the chow for achieving a game winning condition only having chows and an eye in the simple suit. In the third preference parameter set, the combination points of the chow, the pong, the eye, the sequence pair and the hole-sequence pair are 50, 200, 50, 10 and 10, respectively. In the fourth preference parameter set, the combination points of the chow, the pang, the eye, the sequence pair and the hole-sequence pair are 200, 50, 30, 50 and 30, respectively.

TABLE 2

| Preference Parameter | Third Set | Fourth Set |
|---|---|---|
| Chow | 50 | 200 |
| Pong | 200 | 50 |
| Eye | 50 | 30 |
| Sequence Pair | 10 | 50 |
| Hole-Sequence Pair | 10 | 30 |
| Pong Threshold | 20 | 200 |
| Chow Threshold | 200 | 20 |

Figure 8:
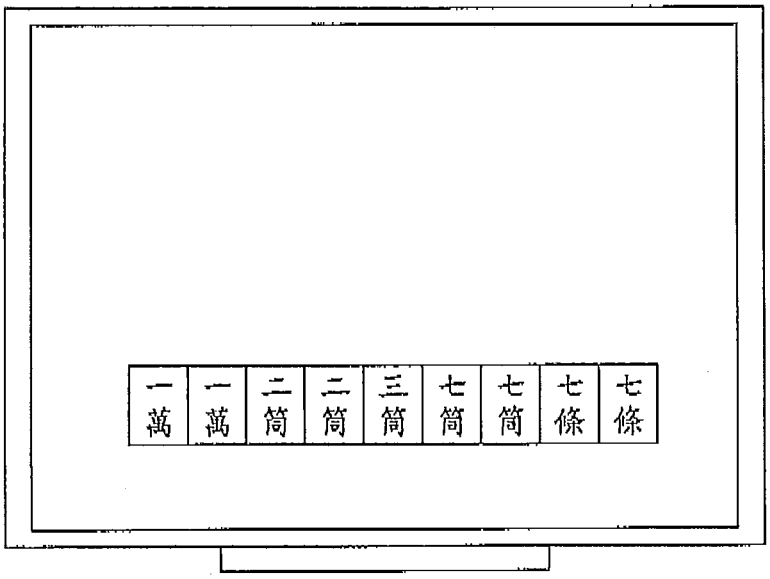
FIG. 8 is a gaming image of Mahjong illustrating another example of hand tiles of a virtual player.

Referring to FIG. 8, the hand tiles include two Characters with the number 1 (一萬), two Dots with the number 2 (二筒), one Dot with the number 3 (三筒), two Dots with the number 7 (七筒), and two Bamboos with the number 7 (七條), In the case of the third virtual player, the priority points of the hand tiles (一萬, 二筒, 三筒, 七筒, 七條) are computed as 10, −15, −25, 20 and 20, respectively. Since the priority point of the Dot with the number 3 (三筒), i.e., −25, is the least among the priority points of the hand tiles, the control unit 13 is operable to make the third virtual player to discard the Dot with the number 3 (三筒). In the case of the fourth virtual player, the priority points of the hand tiles (一萬, 二筒, 三筒, 七筒, 七條) are computed as −10, 15, 20, 0 and 0, respectively. Accordingly, the fourth virtual player will discard one of the Characters with the number 1 (一萬) having the least priority point.

In Table 3, a fifth preference parameter set is associated with a fifth virtual player who prefers to keep the virtual playing tiles in the honor suits (i.e., Winds and Dragons) for additional scores of the pang of the Dragons or particular Winds. In the fifth preference parameter set, the preset points of tile points corresponding to the simple suits (i.e., Characters, Dots and Bamboos) are −10, compared to 30 for the honor suits,

TABLE 3

| Preference Parameter | Fifth Set | Standard Set |
|---|---|---|
| Character | −10 | 10 |
| Dot | −10 | 10 |
| Bamboo | −10 | 10 |
| Wind | 30 | 10 |
| Dragon | 30 | 10 |

Referring to FIG. 9, the hand tiles include one Character with the number 3 (三萬), one Character with the number 4 (四萬), one Character with the number 7 (七萬), one Dot with the number 3 (三筒), and one East Wind (東風). In the case of the fifth virtual player, the priority points of the hand tiles (三萬, 四萬, 七 萬, 三筒, 東風) are computed as −30, −30, −50, −50 and −10, respectively. Since the priority points of the Character with the number 7 (七萬) and the Dot with the number 3 (三筒) are less than the priority points of other hand tiles, the control unit 13 is operable to make the fifth virtual player discard one of the Character with the number 7（七萬）and the Dot with the number 3（三筒）. In the case of a standard virtual player associated with the standard preference parameter set 30 shown in FIG. 3, the priority points of the hand tiles（三萬，四萬，七萬，三筒，東風）are computed as −10, −10, −30, −30 and −40, respectively. Accordingly, the standard virtual player will discard the East Wind（東風）having the least priority point.

In particular, there is a special game winning condition having an extremely high score, named Clean Hand in which only the honor suits and one of the simple suits are used. Table 4 gives an example of a sixth preference parameter set associated with a sixth virtual player who prefers to achieve the Clean Hand. In the sixth preference parameter set, the preset points of tile points corresponding to the simple suits (i.e., Characters, Dots and Bamboos) are −50. The sixth preference parameter set further includes a most-suit point that is equal to 100. The most-suit point will be used to replace the preset point of each of the hand tiles in one of the simple suits when a number of the hand tiles in said one of the simple suits is greater than a number of the hand tiles in any one of the other two of the simple suits.

TABLE 4

| Preference Parameter | Fifth Set | Standard Set |
|---|---|---|
| Character | −50 | 10 |
| Dot | −50 | 10 |
| Bamboo | −50 | 10 |
| Most Suit | 100 | None |

Figure 10:
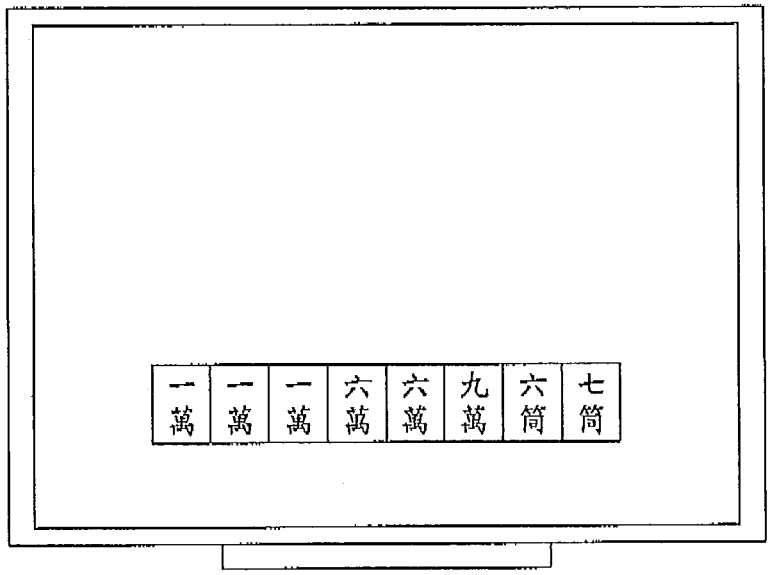
FIG. 10 is a gaming image of Mahjong illustrating a further example of hand tiles of a virtual player.

Referring to FIG. 10, the hand tiles include three Characters with the number 1（一萬），two Characters with the number 6（六萬），one Character with the number 9（九萬），one Dot with the number 6（六筒），and one Dot with the number 7（七筒）. In the case of the sixth virtual player, the priority points of the hand tiles（一萬，六萬，九萬，六筒，七筒）are computed as 200, 90, 50, −70 and −70, respectively. Since the priority points of the Dot with the number 6（六筒）and the Dot with the number 7（七筒）are less than the priority points of other hand tiles, the sixth virtual player will discard one of the two Dots with the number 6 or number 7（六 筒，七筒）. In the case of the standard virtual player associated with the standard preference parameter set 30 shown in FIG. 3, the priority points of the hand tiles（一萬，六萬，九萬，六筒，七筒）are computed as 110, 0, −40, −10 and −10, respectively. Accordingly, the standard virtual player will discard the Character with the number 9（九萬）having the least priority point.

In summary, since the preference parameter sets of various virtual players are different, each of the virtual players may prefer to achieve a different kind of the game winning condition. Thus, the gaming apparatus 1 of this invention is capable of simulating the virtual player with its own preference and personality by executing the machine-implemented method of handling the hand tiles/cards of the virtual player.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A machine-implemented method of handling a plurality of hand tiles/cards of a virtual player during a tile/card game, the tile/card game to be played using a plurality of virtual playing tiles/cards from which the hand tiles/cards are drawn, said machine-implemented method to be performed by a gaming apparatus and comprising the steps of:

a) configuring the gaming apparatus to store a preference parameter set associated with the virtual player, the preference parameter set including tile/card points of the respective virtual playing tiles/cards used in the tile/card game and combination points of various permissible combinations of the virtual playing tiles/cards;

b) during a turn of the virtual player, configuring the gaming apparatus to compute priority points of the respective hand tiles/cards of the virtual player according to the preference parameter set associated with the virtual player; and c) configuring the gaming apparatus to make the virtual player discard one of the hand tiles/cards that is selected according to the priority points when a game winning condition is yet to be met.

2. The machine-implemented method as claimed in claim 1, wherein, for each of the hand tiles/cards of the virtual player, step b) includes the sub-steps of;

configuring the gaming apparatus to add the tile/card point of the virtual playing tile/card, to which the hand tile/card corresponds, to the priority point;

configuring the gaming apparatus to determine whether the hand tile/card can be used for composing one of the permissible combinations with at least one of other hand tiles/cards of the virtual player; and when it is determined that the hand tile/card can be used for composing one of the permissible combinations with at least one of other hand tiles/cards, configuring the gaming apparatus to add the combination point of said one of the permissible combinations to the priority point.

3. The machine-implemented method as claimed in claim 2, wherein, in step c), the gaming apparatus is configured to make the virtual player discard one of the hand tiles/cards that corresponds to a least one of the priority points.

4. The machine-implemented method as claimed in claim 1, the tile/card game being Mahjong to be played using a plurality of the virtual playing tiles that are split into three simple suits and two honor suits, the permissible combinations of the virtual playing tiles including a pong that is a set of identical three of the virtual playing tiles and a chow that is a set of sequential three of the virtual playing tiles in one of the simple suits, wherein, in the preference parameter set, the tile point of each of the virtual playing tiles belonging to one of the simple suits includes a preset point corresponding to said one of the simple suits and a configurable point related to a numerical sequence of the virtual playing tiles in said one of the simple suits, and the tile point of each of the virtual playing tiles belonging to the honor suits includes a preset point corresponding to said one of the honor suits;

wherein step b) includes the sub-steps of:

b1) configuring the gaming apparatus to determine a possible arrangement of the hand tiles of the virtual player, the possible arrangement having at least one of the permissible combinations composed by a part of the hand tiles, b2) for each of the hand tiles, configuring the gaming apparatus to determine whether the hand tile belongs to the honor suits or the simple suits, b3) when it is determined in sub-step b2) that the hand tile belongs to one of the honor suits, configuring the gaming apparatus to add the preset point corresponding to said one of the honor suits to the priority point of the hand tile, b4) when it is determined in sub-step b2) that the hand tile belongs to one of the simple suits, configuring the gaming apparatus to add the preset point corresponding to said one of the simple suits and the configurable point corresponding to order of the hand tile in said one of the simple suits to the priority point of the hand tile, b5) for each of the hand tiles, configuring the gaming apparatus to determine whether the hand tile can be used for composing one of the pong and the chow with other hand tiles in the possible arrangement, b6) configuring the gaming apparatus to add the combination point of said at least one of the pong and the chow in the possible arrangement to the priority point of the hand tile when the determination made in sub-step b5) is affirmative, and to add a non-meld point less than the combination point of the pong and the chow to the priority point when otherwise, and b7) configuring the gaming apparatus to determine whether there is another possible arrangement of the hand tiles of the virtual player, and to repeat sub-steps b2) to b7) with said another possible arrangement when determination is affirmative.

5. The machine-implemented method as claimed in claim 4, the permissible combinations of the virtual playing tiles further including an eye that is a pair of identical two of the virtual playing tiles, a sequence pair of sequential two of the virtual playing tiles in one of the simple suits, and a hole-sequence pair of two out of three of the virtual playing tiles in a chow;

wherein step b) further includes, before sub-step b7), the sub-steps of:

for each of the hand tiles, configuring the gaming apparatus to determine whether the hand tile can be used for composing at least one of the eye, the sequence pair and the hole-sequence pair with another hand tile in the possible arrangement; and configuring the gaming apparatus to add the combination point of said at least one of the eye, the sequence pair and the hole-sequence pair in the possible arrangement to the priority point of the hand tile when the determination thus made is affirmative.

6. The machine-implemented method as claimed in claim 4, the permissible combinations of the virtual playing tiles further including an eye that is a pair of identical two of the virtual playing tiles, a sequence pair of sequential two of the virtual playing tiles in one of the simple suits, and a hole-sequence pair of two out of three of the virtual playing tiles in a chow;

wherein step b) further includes the sub-steps of:

when it is determined in sub-step b5) that the hand tile can be used with one of other hand tiles for composing one of the eye, the sequence pair and the hole-sequence pair, configuring the gaming apparatus to determine whether there is still at least one of the virtual playing tiles that can be used for composing one of the pong and the chow with the hand tile and said one of other hand tiles and that remains concealed;

when it is determined that there is still said at least one of the virtual playing tiles, configuring the gaming apparatus to determine a number of said at least one of the virtual playing tiles that remains concealed; and configuring the gaming apparatus to add a ratio of the combination point associated with one of the eye, the sequence pair and the hole-sequence pair to the priority point of the hand tile according to the number of said at least one of the virtual playing tiles that remains concealed.

7. The machine-implemented method as claimed in claim 4, wherein step b) further includes the sub-steps of:

after sub-step b1), for each of the hand tiles, configuring the gaming apparatus to determine whether one of a last player and a next player with respect to the virtual player has discarded one of the virtual playing tiles that is identical or adjacent to the hand tile in terms of numerical sequence;

when it is determined that the last player has discarded said one of the virtual playing tiles, configuring the gaming apparatus to add an additional positive point to the priority point of the hand tile; and when it is determined that the next player has discarded said one of the virtual playing tiles, configuring the gaming apparatus to add an additional negative point to the priority point of the hand tile.

8. The machine-implemented method as claimed in claim 4, wherein, in sub-step b6), the non-meld point has a negative value.

9. The machine-implemented method as claimed in claim 1, wherein the tile/Card point of each of the virtual playing tiles/cards is a sum of a preset point and a respective configurable point.

10. A non-transitory computer program product comprising a machine readable storage medium having program instructions stored therein which when executed cause a gaming apparatus to perform a machine-implemented method of handling a plurality of hand tiles/cards of a virtual player during a tile/card game according to claim 1.

11. A gaming apparatus operable to allow a user to play a tile/card game with at least one virtual player using a plurality of virtual playing tiles/cards, said gaming apparatus comprising:

a storage unit storing a preference parameter set associated with the virtual player and program instructions for performing a machine-implemented method of handling a plurality of hand tiles/cards of the virtual player during the tile/card game, the preference parameter set including tile/card points of the respective virtual playing tiles/cards used in the tile/card game and combination points of various permissible combinations of the virtual playing tiles/cards; and a control unit operable to execute the program instructions stored in said storage unit to implement the machine-implemented method that includes the steps of:

i) during a turn of the virtual player, computing priority points of the respective hand tiles/cards of the virtual player according to the preference parameter set associated with the virtual player; and ii) making the virtual player discard one of the hand tiles/cards that is selected according to the priority points when a game winning condition is yet to be met.

12. The gaming apparatus as claimed in claim 11, the tile/card game being Mahjong to be played using a plurality of the virtual playing tiles, wherein said control unit is operable to compute a total point of the hand tiles of the virtual player as a sum of the respective priority points of the hand tiles;

when there is a chance to meld a discarded playing tile from another player for completing one of the permissible combinations, compute an assumed point of the hand tiles after melding and compare the assumed point with the total point; and make the virtual player meld the discarded playing tile when the assumed point is greater than the total point with a threshold value.

13. The gaming apparatus as claimed in claim 11, the tile/card game being Mahjong to be played using a plurality of the virtual playing tiles that are split into three simple suits and two honor suits, the permissible combinations of the virtual playing tiles including a pong that is a set of identical three of the virtual playing tiles and a chow that is a set of sequential three of the virtual playing tiles in one of the simple suits, wherein:

in the preference parameter set stored in said storage unit, the tile point of each of the virtual playing tiles belonging to one of the simple suits includes a preset point corresponding to said one of the simple suits and a configurable point related to a numerical sequence of the virtual playing tiles in said one of the simple suits, and the tile point of each of the virtual playing tiles belonging to the honor suits includes a preset point corresponding to said one of the honor suits;

step i) of the machine-implemented method includes the sub-steps of:

i1) determining a possible arrangement of the hand tiles of the virtual player, the possible arrangement having at least one of the permissible combinations composed by a part of the hand tiles, i2) for each of the hand tiles, determining whether the hand tile belongs to one of the honor suits and the simple suits, i3) when it is determined in sub-step i2) that the hand tile belongs to one of the honor suits, adding the preset point corresponding to said one of the honor suits to the priority point of the hand tile, i4) when it is determined in sub-step i2) that the hand tile belongs to one of the simple suits, adding the preset point corresponding to said one of the simple suits and the configurable point corresponding to the order of the hand tile in said one of the simple suits to the priority point of the hand tile, i5) for each of the hand tiles, determining whether the hand tile can be used for composing said at least one of pong and chow with other hand tiles in the possible arrangement, i6) adding the combination point of said at least one of the pong and the chow in the possible arrangement to the priority point of the hand tile when the determination made in sub-step i5) is affirmative, and adding a non-meld point less than the combination point to the priority point when otherwise, and i7) determining whether there is another possible arrangement of the hand tiles of the virtual player, and repeating sub-steps i2) to i7) with said another possible arrangement when determination is affirmative.

14. The gaming apparatus as claimed in claim 13, the permissible combinations of the virtual playing tiles further including an eye that is a pair of identical two of the virtual playing tiles, a sequence pair of sequential two of the virtual playing tiles in one of the simple suits, and a hole-sequence pair of two out of three of the virtual playing tiles in a chow;

wherein step i) of the machine-implemented method further includes, before sub-step i7), the sub-steps of:

for each of the hand tiles, determining whether the hand tile can be used for composing at least one of the eye, the sequence pair and the hole-sequence pair with another hand tile in the possible arrangement; and adding the combination point of said at least one of the eye, the sequence pair and the hole-sequence pair in the possible arrangement to the priority point of the hand tile when the determination thus made is affirmative.

15. The gaming apparatus as claimed in claim 13, the permissible combinations of the virtual playing tiles further including an eye that is a pair of identical two of the virtual playing tiles, a sequence pair of sequential two of the virtual playing tiles in one of the simple suits, and a hole-sequence pair of two out of three of the virtual playing tiles in a chow;

wherein step i) of the machine-implemented method further includes the sub-steps of;

when it is determined in sub-step i5) that the hand tile can be used with one of other hand tiles for composing one of the eye, the sequence pair and the hole-sequence pair, determining whether there is still at least one of the virtual playing tiles that can be used for composing one of the pong and the chow with the hand tile and said one of other hand tiles and that remains concealed;

when it is determined that there is still said at least one of the virtual playing tiles, determining a number of said at least one of the virtual playing tiles that remains concealed; and adding a ratio of the combination point associated with one of the eye, the sequence pair and the hole-sequence pair to the priority point of the hand tile according to the number of said at least one of the virtual playing tiles that remains concealed.

16. The gaming apparatus as claimed in claim 13, wherein step i) of the machine-implemented method further includes the sub-steps of:

after sub-step b1), for each of the hand tiles, determining whether one of a last player and a next player with respect to the virtual player has discarded one of the virtual playing tiles that is identical or adjacent to the hand tile in terms of numerical sequence;

when it is determined that the last player has discarded said one of the virtual playing tiles, adding an additional positive point to the priority point of the hand tile; and when it is determined that the next player has discarded said one of the virtual playing tiles, adding an additional negative point to the priority point of the hand tile.

17. The gaming apparatus as claimed in claim 13, wherein, in sub-step i6), the non-meld point has a negative value.

18. The gaming apparatus as claimed in claim 11, the virtual playing tiles/cards being split into at least a first suit and a second suit, wherein, in the preference parameter set stored in said storage unit, the tile/card point of each of the virtual playing tiles/cards that belong to the first suit includes a preset point corresponding to the first suit and a respective configurable point, and the tile/card point of each of the virtual playing tiles/cards that belong to the second suit includes a preset point corresponding to the second suit.

19. The gaming apparatus as claimed in claim 11, wherein said storage unit stores a preference table containing the preference parameter set therein.

* * * * *